US006666412B1

(12) United States Patent
Achleitner et al.

(10) Patent No.: US 6,666,412 B1
(45) Date of Patent: Dec. 23, 2003

(54) DEVICE FOR ADJUSTING AND ELASTICALLY LOCKING MOVEABLE SWITCH PARTS

(75) Inventors: Herbert Achleitner, Graz (AT); Josef Hörtler, Knittelfeld (AT); Armin Lassacher, Murau (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 10/031,009

(22) PCT Filed: May 10, 2000

(86) PCT No.: PCT/AT00/00130

§ 371 (c)(1),
(2), (4) Date: May 9, 2002

(87) PCT Pub. No.: WO00/69697

PCT Pub. Date: Nov. 23, 2000

(30) Foreign Application Priority Data

May 14, 1999 (AT) ..... 864/99

(51) Int. Cl.[7] ..... B61L 5/00
(52) U.S. Cl. ..... 246/450; 246/448
(58) Field of Search ..... 246/448, 449, 246/450, 452

(56) References Cited

FOREIGN PATENT DOCUMENTS

| | | | |
|---|---|---|---|
| AT | 406038 B | 1/2000 | ..... B61L/5/10 |
| DE | 3228759 A1 | 4/1984 | ..... E01B/7/02 |
| DE | 29802122 U1 | 4/1998 | ..... B61L/5/00 |
| WO | WO 98/54041 | 12/1998 | ..... B61L/5/10 |

*Primary Examiner*—Mark T. Le
(74) *Attorney, Agent, or Firm*—Chapman & Cutler LLP

(57) ABSTRACT

A device for switching and elastically locking the end positions of movable switch parts, in particular switch tongues of grooved rail switches, including an axially displaceable rod (15) and a tube (17) surrounding the rod, in which a spring (29) encompassing the rod is braced against stops and locking members (26, 26') capable of being displaced radially outwards are arranged, wherein the rod (15) has axially spaced-apart control stops (24, 25) for a radially inward position of the locking members (26, 26') and the tube (17) has stops (32, 33) for the outward position of the locking members (26, 26'), wherein at least one (25) of the control stops (24, 25) of the rod (15) is displaceable relative to at least another one (24) of the control stops (24, 25) in the axial direction of the rod (15) and is capable of being fixed in the respective displaced position.

29 Claims, 2 Drawing Sheets

DEVICE FOR ADJUSTING AND ELASTICALLY LOCKING MOVEABLE SWITCH PARTS

Figure 1:
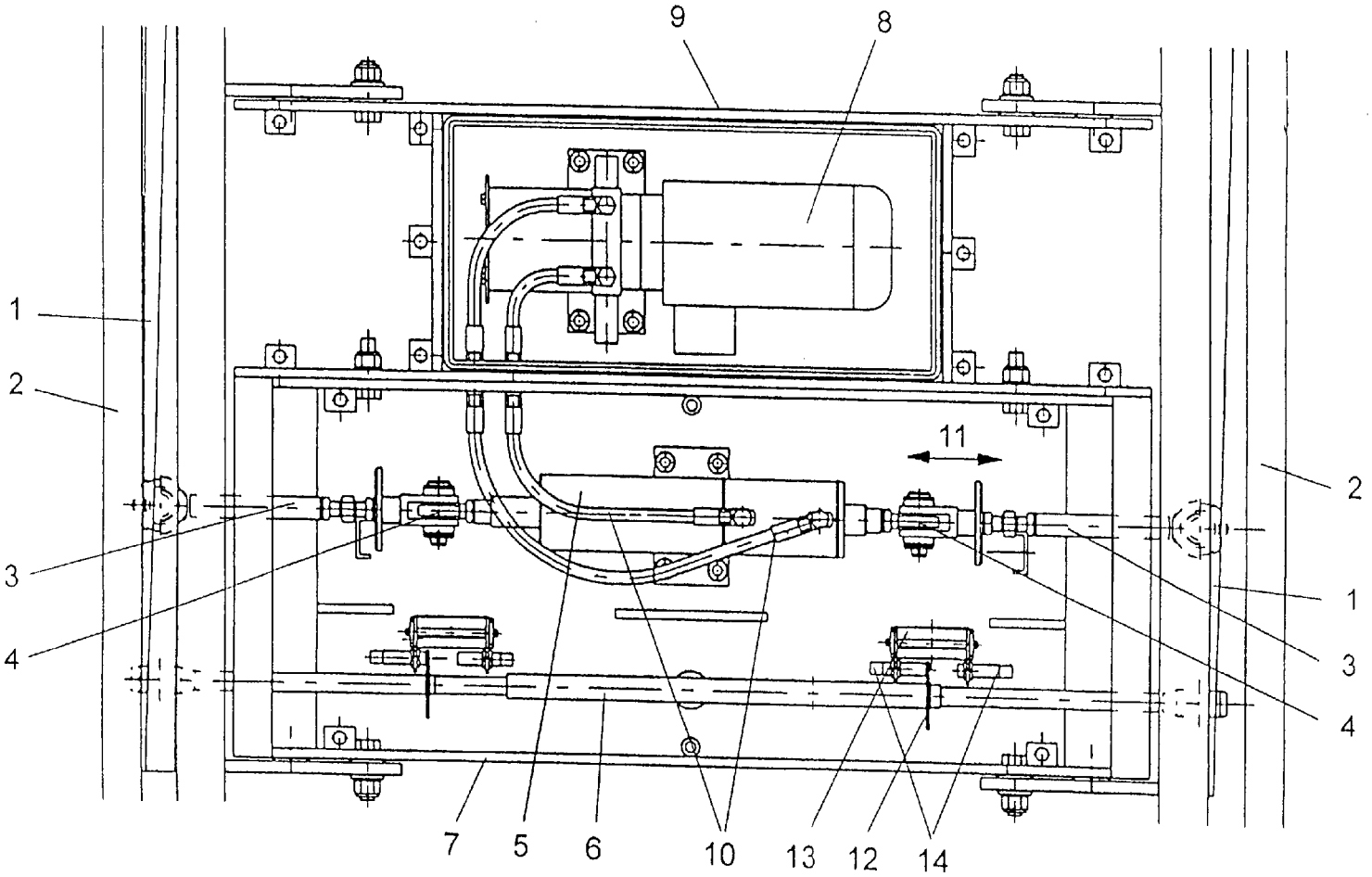

The invention relates to a device for switching and elastically locking the end positions of movable switch parts, in particular switch tongues of grooved rail switches, including an axially displaceable rod and a tube surrounding the rod, in which a spring encompassing the rod is braced against stops and locking members capable of being displaced radially outwards are arranged, wherein the rod has axially spaced-apart control stops for a radially inward position of the locking members and the tube has stops for the outward position of the locking members.

In addition to using a so-called switch lock including a clamp-like catch unit to lock movable switch parts, EP 603 156 A1 has already suggested a configuration in which extra-axial loads on the lock are avoided, enabling the realization of a completely closed mode of construction. In that known locking device, which may also be used as a switching aid with the appropriate arrangement of pressure springs, a rod is arranged in an axially displaceable tube, which, in turn, is itself arranged in a stationary tube. Locking members were displaceably guided within the axially displaceable tube in the radial direction, and recesses were each provided in the stationary tube and in the rod to cooperate with the locking members during displacement and in the end position. When using such an arrangement as a switching aid in support of the displacement movement, two pressure springs were used, which involved high overall expenditures in terms of construction. Embodiments of a switching aid are also known from AT 379 624, which uses a spring rocker in which an angle lever is mounted in the crossing point of the arms, wherein a force accumulator is supported against the arms of the two angle levers by means of a pressure spring. Two spring rockers were connected with the two tongue rails via coupling rods.

From Austrian application A 2137/97 a switching aid used to elastically lock movable switch parts is known, in which locking members are mounted in an axially spaced-apart relationship in cages arranged between a tube and a rod, a pressure spring acting in the axial direction being arranged between those cages. The rod is connected with the tongue rails via coupling rods, wherein control grooves are provided about the periphery of the rod to move the locking members into their different positions such that the pressure spring will be tensioned during the switching procedure and exert an application force on the tongue in the position of abutment of the tongue on the grooved rails. The ball cages are axially movable to a limited extent such that they may be used with different tongue impacts or different transverse movements of the tongue. The pressure spring in those known devices exerts different forces on the tongue, depending on the tension length.

In EP-A1 603 156 different locking arrangements and switching aids are described with an actuating means being arranged between two substantially identically constructed switching aids. In the main, such configurations have relatively large structural lengths, thus rendering their use with small rail gages and, in particular, grooved rails not readily feasible.

From FR-A-2 523 537 a switching aid comprising an integrated hydraulic actuating means has been known, wherein spring rockers are designed in the form of two pressure springs which are supported on the housing of the ground box and enter into effect as predetermined dead center positions have been exceeded. Finally, EP-A1 0 779 197 discloses a device for securing the end positions of hydraulic actuating drives.

All known devices have in common that their displacement strokes cannot be readily changed and adapted to the respective requirements.

The invention aims to provide the conditions for a compact short-structured actuating and switching aid which is suitable, in particular, for use in grooved rails because of its short structural length and which ensures that the resilient force of application on the tongue will become effective irrespective of a respectively adjustable active displacement path in order to enable the creation of constant application forces on the tongue irrespective of the displacement stroke. Due to the compact mode of construction, also the possible occurrence of transverse forces is to be reduced so as to enable a substantial reduction of wear.

To solve this object, the configuration according to the invention essentially consists in that at least one of the control stops is fixable to the rod in a manner displaceable in the axial direction of the rod. Due to the fact that at least one of the control stops is fixable to the rod in a manner displaceable in the axial direction of the rod, it is feasible in a simple manner to adjust the stroke and hence the respectively required displacement path, the displaceability and fixability of the control stops, at the same time, ensuring that the full and constant spring force becomes effective at the end of the stroke.

In this context, the configuration according to the invention in a particularly simple manner may be devised such that the rod is dividedly designed, wherein the axial position of a rod part carrying a control stop is variable relative to the other rod part. The change of the axial length of the rod part with the simultaneous axial shift of the control stop, in principle, may be realized in different ways. If the axial length of one rod part is changed relative to the other rod part, this may be effected, for instance, in that one rod part is designed to have an external thread and the second rod part is designed to have an internal thread, the rod part having the external thread being screwed into, or out of, the rod part having the internal thread. In a particularly simple manner, the configuration may be devised such that the adjustable control stop is designed as an end face of a sleeve which is capable of being screwed on the rod and connected on its free end to the movable rail part via the coupling rod.

Such a sleeve carrying the adjustable control stop may be screwed on the rod in a simple manner and is easily adjustable even subsequently. Above all, such a device also can be secured against unintentional displacement, and arrested or blocked in the respectively selected position of the sleeve, in a particularly simple manner. To this end, the configuration preferably is devised such that the sleeve comprises an internal thread into which a locking piece carrying an external thread may be screwed in abutment on the rod in the manner of a counternut.

In order to comply with the requirements of a particularly compact mode of construction and hence ensure the preferred aptness for grooved rail switches, the configuration advantageously is devised such that the actuating means is comprised of a displaceable cylinder piston unit integrated in the tube coaxially with the axis or rod, the maximum displacement path of which cylinder piston unit is larger than the admissible adjustment range of the control stop or sleeve, respectively. Such an integration of a hydraulic actuating means in the switching and locking device results in particularly short dimensions and, at the same time, a reduced risk of eccentric off-center forces that might involve an increased wear. Particularly compact dimensions may be obtained if the piston of the cylinder piston unit is rigidly connected with the rod, the piston rod being identical with the rod carrying the control stops.

A configuration secured against the penetration of dust may be obtained in that the tube is closed by end faces on both sides, wherein, in a manner known per se, the locking members preferably are designed as balls and radially guided in axially displaceable cages with the spring being arranged between the mutually facing end faces of the cages.

In order to ensure the safe operation of the switching device even from the end positions, the configuration advantageously is devised such that the cages are located in end positions of the displacement path at a distance from the end faces of the tube.

In the following, the invention will be explained in more detail by way of an exemplary embodiment schematically illustrated in the drawing. Therein, FIG. 1 is a top view on a schematic arrangement of the device according to the invention; and FIG. 2 is an axial section through a device for elastically locking and adjusting switch parts, comprising an integrated hydraulic actuating means.

FIG. 1 depicts a grooved rail switch, the movable switch tongues being denoted by 1 and the stock rail being denoted by 2. The switch tongues 1 are connected with the device according to the invention for switching and elastically locking movable switch parts 5 via a tongue rod assembly 3 and universal joints 4. The switching device 5 is mounted in a first U-shaped open box 7 together with the check rod assembly 6. Due to the coupled mode of construction of the switching device, its installation in an open ground box is feasible, thus offering easy accessibility for servicing measures. The electrohydraulic drive 8 is firmly attached to the box 7 in a tightly sealed separate box part 9. Both box parts are provided with a cover plate, wherein the overall box structure is embedded so as to be insulated against the rails, if required. Ducts 10 lead from the electrohydraulic drive 8 to a cylinder piston unit integrated in the switching device 5 and described in more detail below, by which the tongue rod assembly 3 is actuated in the sense of double arrow 11. Furthermore, it is apparent from FIG. 1 that the check rod assembly 6 arranged in parallel is provided with actuating plates 12 which get into contact with inductive proximity switches 14 in the respective abutment position of the tongue, thus providing also an electrical monitoring of the arrangement in addition to the mechanical one. In order to adapt the proximity switches 14 to the required stroke of the switching device 5, the former are arranged in a manner that their mutual distance may be altered by the aid of an adjusting member 13.

Figure 2:
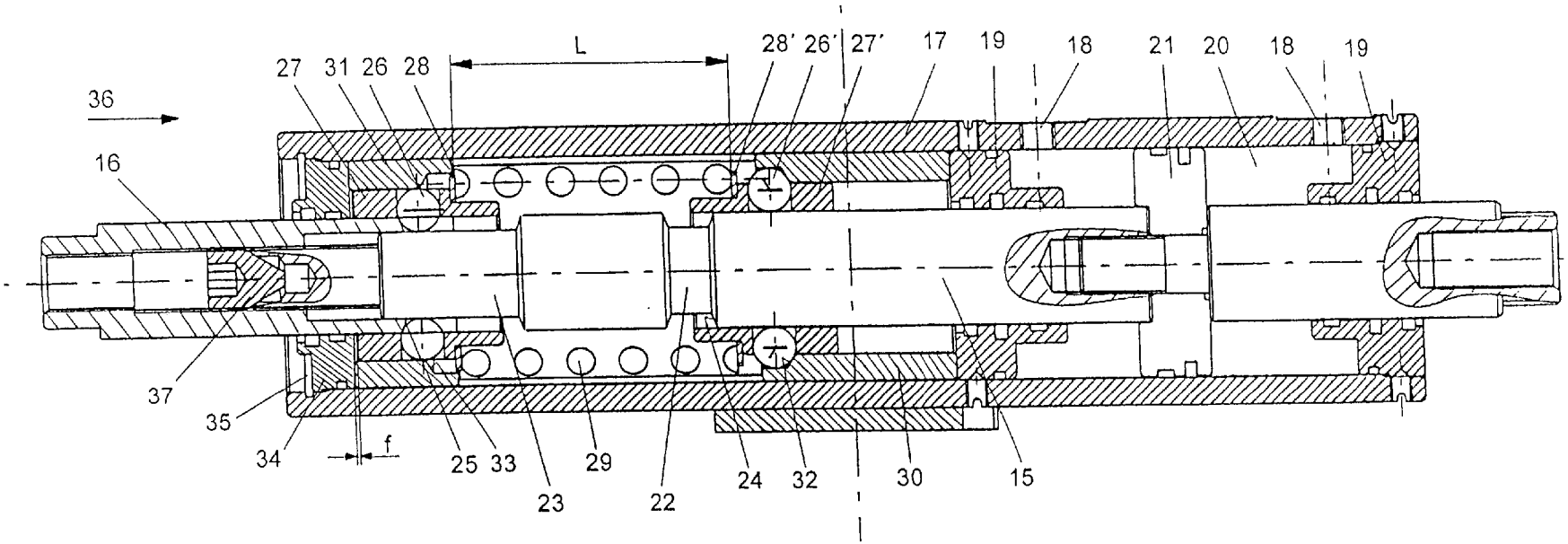

FIG. 2 depicts the switching device in a position in which the tongue abuts the stock rail on the left-hand side. The external tube, which is denoted by 17, constitutes the housing for the switching device. Coaxially with the external tube are arranged a rod 15 and a sleeve 16 screwed on the rod 15, which sleeve is connected with the universal joints illustrated in FIG. 1 on its free ends. In the external tube 17 are arranged two cylinder blocks 19 delimiting a cylinder space 20 and sealingly closing the latter towards outside and towards that part of the device which is illustrated in the drawing on the left-hand side. A cylinder piston 21 is screwed on the rod 15 in the region of the cylinder space 20 and may be powered with the pressure of a hydraulic liquid supplied and discharged via connections 18 provided in the external tube 17 and the hydraulic ducts 10 illustrated in FIG. 1. In its left-hand section adjacent the cylinder piston unit, the external tube 17 receives the device for elastically locking the switch tongue. The rod 15 on its circumference comprises a groove 22 having a trapezoidal cross section and includes a section 23 having a smaller diameter, which section 23, together with the end face 25 of the sleeve 16 screwed on the rod 15, forms a second groove that is also trapezoidal in cross section. The end face 25 of the sleeve 16, at the same time, constitutes a control stop for the radially inward position of a first locking member, which is comprised of balls 26 and radially guided within an axially displaceable cage 27. The stop for the radially inward position of the second locking member, which is again comprised of balls 26' and a cage 27', is realized by the stop 24 of the groove 22. Each of the cages 27 and 27' comprises a supporting ring 28 and 28', respectively, on which a pressure spring 29 acting between the cages 27 and 27' is supported. Tube sections 30 and 31 are inserted in the stationary external tube 17 and comprise stops 32 and 33 for the radially outward position of the locking members. The tube section 30 is supported on the cylinder block 19 and the tube section 31 is supported on the external lid 34 which is fixed in its axial position by a securing ring 35. During a switching movement in the sense of arrow 36, the spring 29 is at first compressed until the locking members 26 are shifted radially outwards into stop 33. The further displacement of the rod 15 in the sense of arrow 36 is free of any spring force action until the locking members 26' enter the groove 22 of the rod radially inwards and cooperate with the stop 24 in a manner that any further displacement will be assisted by a release of the pressure spring 29 and the resilient abutment of the right-hand tongue will be ensured under the action of the pressure spring 29 after the right-hand end position has been reached. After completion of the switching procedure, the hydraulics of the cylinder piston unit is switched to circulation, thus exerting no force on the actuating pistons 21. During a switching movement in the direction opposite to arrow 36, the pressure spring 29, which is supported on the stop 33 via the locking member 26, is again compressed over a short path until the locking member 26' emerges from the groove 22 to abut on stop 32. Since the pressure spring 29 is then supported on the two stationary stops 32 and 33, any further displacement movement will be free of spring forces until the locking member 26 can enter the groove 23, whereupon the spring 29 will again exert a force on the control stop 25. As the left-hand end position is reached, the cage 27 has assumed a release position f relative to the lid 34 such that the retention force of the spring will only act on the sleeve 16. By screwing the sleeve 16 on and off, the axial position of the control stop 25 relative to the tube 15 is changed, thus enabling the locking member 26 to enter the groove 23 at another point of time during a displacement movement opposite to the direction of arrow 36. If the sleeve 16 is screwed in a manner that the length of the groove 23 is reduced, the stroke of the switching device will become larger, whereas it will get smaller by a rotation of the sleeve 16 in a manner that the length of the groove 23 is increased. The respective stroke adjustment is secured by the counternut 37. In this constructive configuration, the pressure spring 29 in its end position each has the same overall length L, thus exerting the same pressure force on the rod 15 and the end face of the sleeve 16 in the respective end position. During the switching procedure, the spring 29 is additionally compressed by a slight extent and again released to its length L in the respective end position. Thus, a very short pressure spring may be chosen, since only a small spring travel is required during the switching procedure. There is, thus, provided a linear cylinder/spring rocker arrangement which may be readily encapsulated and sealed towards outside because of its tubular mode of construction. The unit is adjustable for an adjustment stroke of approximately 35 to 60 mm, ensuring an end position securing force of approximately 2600 to 2800 N via the pressure spring. Due to the fact that the hydraulics of the cylinder piston unit is switched to circulation in each of the end positions, the device also enables forced switching by the wheel flanges of the wheels (force opening of the switch). The opening force of the switching mechanism amounts to about 4000 N according to the maximum prestress of the end position securing mechanism and the displacement resistance of the pressure spring of the spring rocker mechanism. Overloads or damage to the adjustment mechanism, however, will not occur in that case.

What is claimed is:

1. A device for switching and elastically locking the end positions of movable switch parts, in particular switch tongues (1) of grooved rail switches, including an axially displaceable rod (15) and a tube (17) surrounding the rod, in which a spring (29) encompassing the rod (15) is braced against stops (28, 28') and locking members (26, 26') capable of being displaced radially outwards are arranged, wherein the rod (15) has axially spaced-apart control stops (24, 25) for a radially inward position of the locking members (26, 26') and the tube (17) has stops (32, 33) for the outward position of the locking members (26, 26'), wherein at least one (25) of the control stops (24, 25) of the rod (15) is displaceable relative to at least another one (24) of the control stops (24, 25) in the axial direction of the rod (15) and is capable of being fixed in the respective displaced position.

2. A device according to claim 1, wherein the rod (15) is dividedly designed, and an axial position of a rod part carrying a control stop is variable relative to another rod part.

3. A device according to claim 1, wherein said at least one displaceable control stop is designed as an end face (25) of a sleeve (16) which is capable of being screwed onto the rod (15) and connected to the switch tongue (1) on its free end via a coupling rod (3).

4. A device according to claim 3, wherein the sleeve (16) comprises an internal thread into which a locking piece (37) carrying an external thread may be screwed in abutment on the rod (15) in the manner of a counternut.

5. A device according to claim 3, further comprising an actuating means comprised of a displaceable cylinder piston unit integrated in the tube (17) coaxially with the rod (15), wherein a maximum displacement path of the cylinder piston unit is larger than an admissible adjustment range of the control stop or sleeve (16).

6. A device according to claim 5, wherein the cylinder piston unit comprises a piston rigidly connected with the rod (15).

7. A device according to claim 1, wherein the tube (17) is closed by end faces (19, 34) on both sides.

8. A device according to claim 1, wherein the locking members (26, 26') are designed as balls and radially guided in axially displaceable cages (27, 27') with the spring (29) being arranged between mutually facing end faces of the cages (27, 27').

9. A device according to claim 8, wherein the cages (27, 27') are located in end positions of a displacement path of the rod (15) at a distance from end faces (19, 34) of the tube (17).

10. A device according to claim 2, wherein said at least one displaceable control stop is designed as an end face (25) of a sleeve (16) which is capable of being screwed onto the rod (15) and connected to the switch tongue (1) on its free end via a coupling rod (3).

11. A device according to claim 10, wherein the sleeve (16) comprises an internal thread into which a locking piece (37) carrying an external thread may be screwed in abutment on the rod (15) in the manner of a counternut.

12. A device according to claim 4, further comprising an actuating means comprised of a displaceable cylinder piston unit integrated in the tube (17) coaxially with the rod (15), wherein a maximum displacement path of the cylinder piston unit is larger than an admissible adjustment range of the control stop or sleeve (16), respectively.

13. A device according to claim 12, wherein the cylinder piston unit comprises a piston rigidly connected with the rod (15).

14. A device according to claim 2, wherein the tube (17) is closed by end faces (19, 34) on both sides.

15. A device according to claim 2, wherein the locking members (26, 26') are designed as balls and radially guided in axially displaceable cages (27, 27') with the spring (29) being arranged between mutually facing end faces of the cages (27, 27').

16. A device according to claim 15, wherein the cages (27, 27') are located in end positions of a displacement path of the rod (15) at a distance from end faces (19, 34) of the tube (17).

17. A device according to claim 3, wherein the tube (17) is closed by end faces (19, 34) on both sides.

18. A device according to claim 4, wherein the tube (17) is closed by end faces (19, 34) on both sides.

19. A device according to claim 5, wherein the tube (17) is closed by end faces (19, 34) on both sides.

20. A device according to claim 6, wherein the tube (17) is closed by end faces (19, 34) on both sides.

21. A device according to claim 3, wherein the locking members (26, 26') are designed as balls and radially guided in axially displaceable cages (27, 27') with the spring (29) being arranged between mutually facing end faces of the cages (27, 27').

22. A device according to claim 4, wherein the locking members (26, 26') are designed as balls and radially guided in axially displaceable cages (27, 27') with the spring (29) being arranged between mutually facing end faces of the cages (27, 27').

23. A device according to claim 5, wherein the locking members (26, 26') are designed as balls and radially guided in axially displaceable cages (27, 27') with the spring (29) being arranged between mutually facing end faces of the cages (27, 27').

24. A device according to claim 6, wherein the locking members (26, 26') are designed as balls and radially guided in axially displaceable cages (27, 27') with the spring (29) being arranged between mutually facing end faces of the cages (27, 27').

25. A device according to claim 7, wherein the locking members (26, 26') are designed as balls and radially guided in axially displaceable cages (27, 27') with the spring (29) being arranged between mutually facing end faces of the cages (27, 27').

26. A device according to claim 21, wherein the cages (27, 27') are located in end positions of a displacement path of the rod (15) at a distance from end faces (19, 34) of the tube (17).

27. A device according to claim 22, wherein the cages (27, 27') are located in end positions of a displacement path of the rod (15) at a distance from end faces (19, 34) of the tube (17).

28. A device according to claim 23, wherein the cages (27, 27') are located in end positions of a displacement path of the rod (15) at a distance from end faces (19, 34) of the tube (17).

29. A device according to claim 26, wherein the cages (27, 27') are located in end positions of a displacement path of the rod (15) at a distance from end faces (19, 34) of the tube (17).

* * * * *